US006718931B2

(12) United States Patent
Morishige et al.

(10) Patent No.: US 6,718,931 B2
(45) Date of Patent: Apr. 13, 2004

(54) RECOIL STARTER

(75) Inventors: Toshinori Morishige, Tokyo (JP); Shuhei Tsunoda, Tokyo (JP); Seiichi Nieda, Tokyo (JP)

(73) Assignee: Starting Industrial Co., Ltd. (JP)

( * ) Notice: Subject to any disclaimer, the term of this patent is extended or adjusted under 35 U.S.C. 154(b) by 167 days.

(21) Appl. No.: 09/981,424

(22) Filed: Oct. 17, 2001

(65) Prior Publication Data

US 2002/0121257 A1 Sep. 5, 2002

(30) Foreign Application Priority Data

Nov. 6, 2000 (JP) ..... 2000-337487

(51) Int. Cl.[7] ..... F02N 1/00

(52) U.S. Cl. ..... 123/185.3; 123/179.28; 123/195 P; 123/185.4

(58) Field of Search ..... 123/185.1, 185.3, 123/179.19, 179.2, 179.25, 179.26, 185.14, 185.4, 195 P

(56) References Cited

U.S. PATENT DOCUMENTS 5,159,845 A * 11/1992 Wada et al. ..... 74/6
5,715,783 A * 2/1998 Osakabe et al. ..... 123/185.3
6,363,901 B1 * 4/2002 Watanabe et al. ..... 123/185.3
6,508,220 B1 * 1/2003 Akaike et al. ..... 123/85.14

* cited by examiner

*Primary Examiner*—Willis R. Wolfe
*Assistant Examiner*—Johnny H. Hoang
(74) *Attorney, Agent, or Firm*—Anthony J. Casella; Gesald E. Hespos

(57) ABSTRACT

A recoil starter has a starter case provided around a starter shaft. A one-way clutch mechanism is formed between one end of the starter shaft and an engine. A reel is mounted rotatably on the starter shaft and a rope is wound in a groove of the reel. A first spiral spring has its ends fixed respectively to the starter case and reel and urges the reel in the direction in which the rope is taken up. A second spiral spring has its ends fixed respectively to the reel and transmits a rotational force of the reel to the starter shaft when the rope is drawn out. The peak load at the engine starting time is absorbed in the second spiral spring.

4 Claims, 4 Drawing Sheets

RECOIL STARTER

BACKGROUND OF THE INVENTION

1. Field of the Invention

This invention relates to a recoil starter used as a starting system for engines, and more particularly to a recoil starter adapted to reduce a peak load at the engine starting time and lessen the influence exerted on the hand, and also a recoil starter having a dust-proofing effect.

2. Description of the Prior Art

In general, this type of recoil starter is provided with a case housing therein a series of mechanisms formed of a reel which has a rope capable of being drawn out and taken up freely, and which is rewound by a spiral spring, and ratchets extended and retracted via inhibit plates; and adapted to be driven by engaging the ratchets with a starting pulley connected directly to an engine. In general, in this type of recoil starter, the hand directly feels the starting torque of the engine through the rope, so that the hand receives shocks. Moreover, very few devices for preventing the entry of dust from a circumference of a shaft into the interior of the recoil starter are provided for structural reasons.

Under the circumstances, the applicant of the present invention previously proposed a recoil starter (Japanese Utility Model Laid-Open No. 190862/1987) formed so as to prevent dust from entering an engine, by connecting a clutch mechanism of the recoil starter and a spiral spring together, and a rope and a reel together by a shaft respectively, forming a bearing, which support these shafts, in a starter case so as to be integral therewith, and providing a seal member in the vicinity of the shaft, and a recoil starters (Japanese Utility Model Laid-Open Nos. 61575/1988 and 92078/1988) formed so as to seal a clutch mechanism and an engine by fixing to a crank case a starter case having a bearing portion extending around an axis of a crankshaft; providing the clutch mechanism on of the crankshaft side of the bearing portion; providing a reel on an outer side of the other starter case; and providing a seal member on a sliding part of an outer circumferential section of the bearing portion, i.e., measures to prevent dust from entering the engine were already taken.

However, in all of the above-mentioned related art recoil starters, the hand directly feels the starting torque of the engine through the rope, so that a peak load (a load imparted to the recoil starter when a piston moves over a compression upper dead center) at the time of an engine starting operation is high. Therefore, a shock due to this load is directly transmitted to the hand and arm to cause an undesirable effect to be produced. Moreover, the measures to prevent the entry of dust into the recoil starter were not substantially taken.

SUMMARY OF THE INVENTION

The present invention has been made in view of these circumstances, and provides a recoil starter capable of solving the problems encountered in the related art recoil starter, reducing a peak load on the recoil starter at the time of an engine starting operation, and lessening a shock given to the hand and arm, and resistant to dust including sand and litter.

According to an aspect of the present invention, the recoil starter is formed of a starter case having a bearing portion extending around an axis of a crankshaft; a starter shaft passed through the bearing portion and adapted to be turned; a one-way clutch mechanism formed between one end portion of the starter shaft, which extends from the bearing portion to the crankshaft, and an engine; a starter case united with the first-mentioned starter case and having a bearing portion supporting the other end portion of the starter shaft; a reel mounted on the portion of the starter shaft which is between the two bearing portions so that the reel can be turned with respect to the starter shaft; a rope wound in a groove of the reel; a spiral spring urged in the direction in which the rope fixed at both end portions thereof to the first-mentioned starter case and reel is taken up; and a spiral spring fixed at both end portions thereof to the reel and starter shaft and adapted to transmit with an elastic action a rotational force of the reel, which occurs when the rope is drawn out, to the starter shaft, a dust seal being provided in the bearing portion provided so as to extend around the axis of the crankshaft.

A related art recoil starter has a transmission line of force of rope→clutch mechanism→engine. On the other hand, in the recoil starter according to the present invention, the shaft is made rotatable to form a transmission line of force of rope→reel→spiral spring→shaft→engine, and the spiral spring having an elastic action is interposed between the shaft and reel so that a peak load at the time of an engine starting operation is absorbed in this spiral spring. Furthermore, the dust seal is provided in the bearing portion provided so as to extend around the axis of the crankshaft.

BRIEF DESCRIPTION OF THE DRAWINGS

A preferred embodiment of the present invention will be described in detail with reference to the following figures, wherein:

FIGS. 4A and 4B are drawings showing the relation between a tractive force (starting torque of the engine) of a rope and a rotational frequency of a reel in a recoil starter, wherein: FIG. 4A shows the mentioned relation in the recoil starter according to the present invention; and FIG. 4B shows the mentioned relation in a related art recoil starter.

DESCRIPTION OF THE PREFERRED EMBODIMENT

Figure 1:
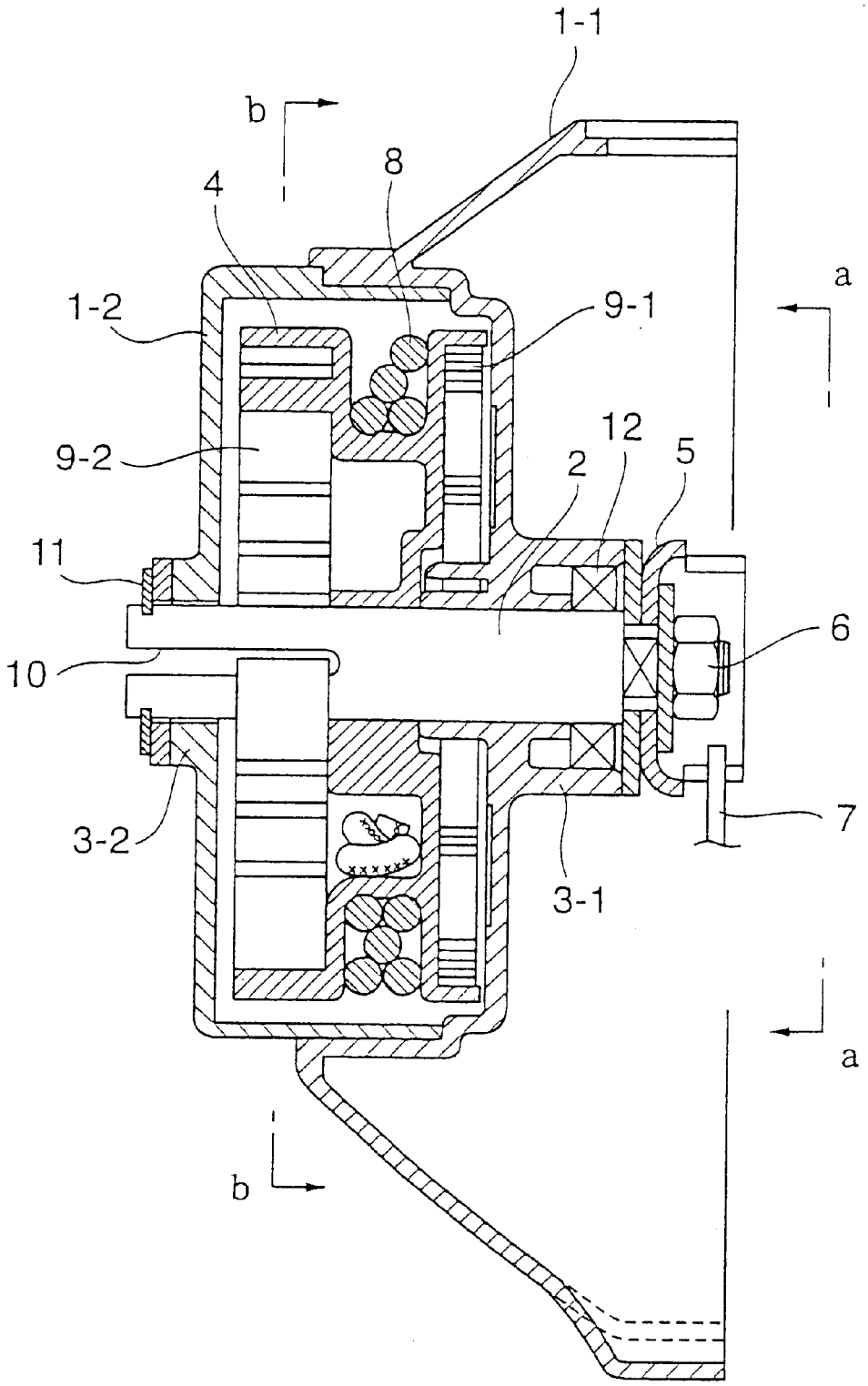
FIG. 1 is a sectioned side view showing an embodiment of the recoil starter according to the present invention.
Figure 2:
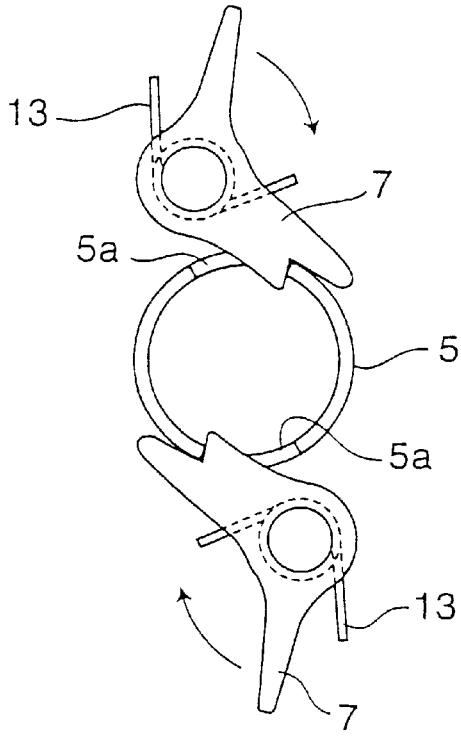
FIG. 2 is a sectional view taken in the direction of arrows a—a in FIG. 1.
Figure 3:
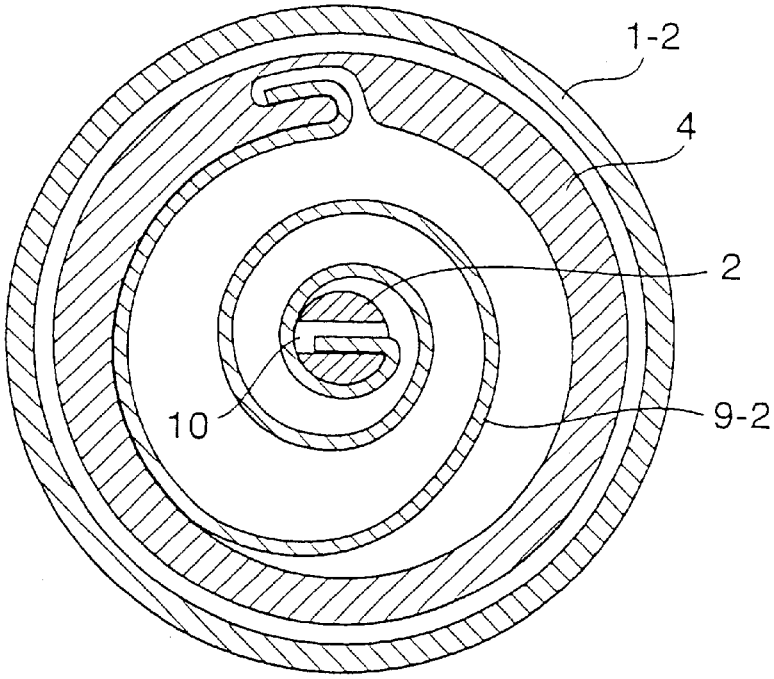
FIG. 3 is a longitudinal sectional view taken along the line b—b in FIG. 1.
Figure 4:
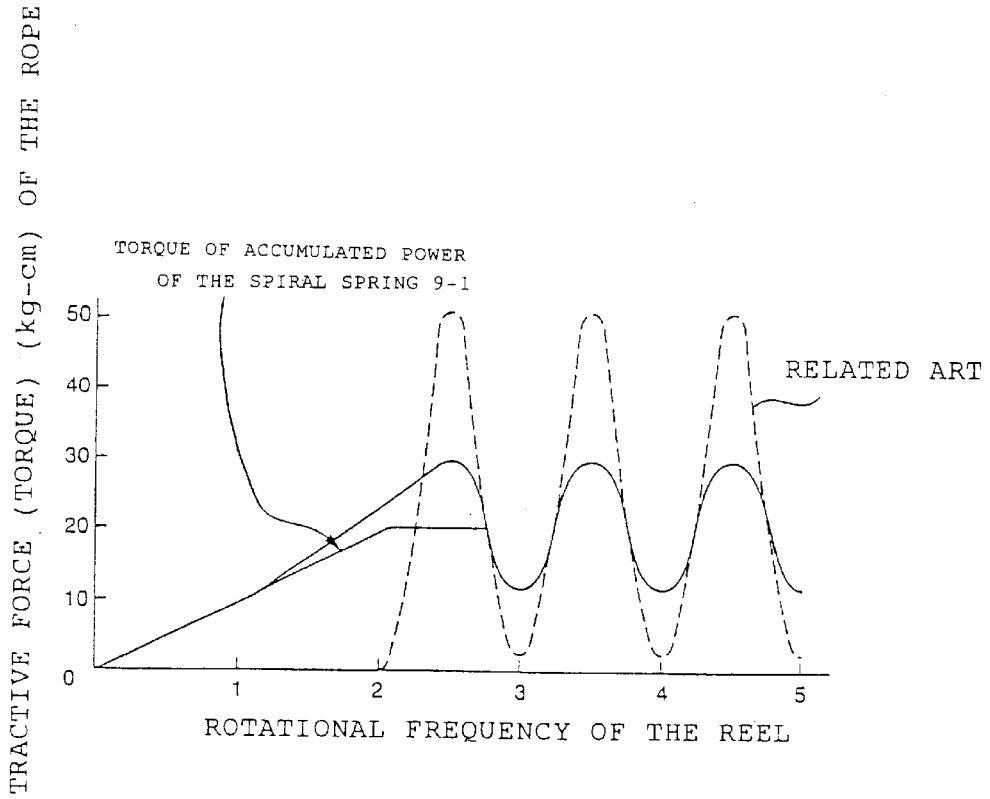
Figure 4:
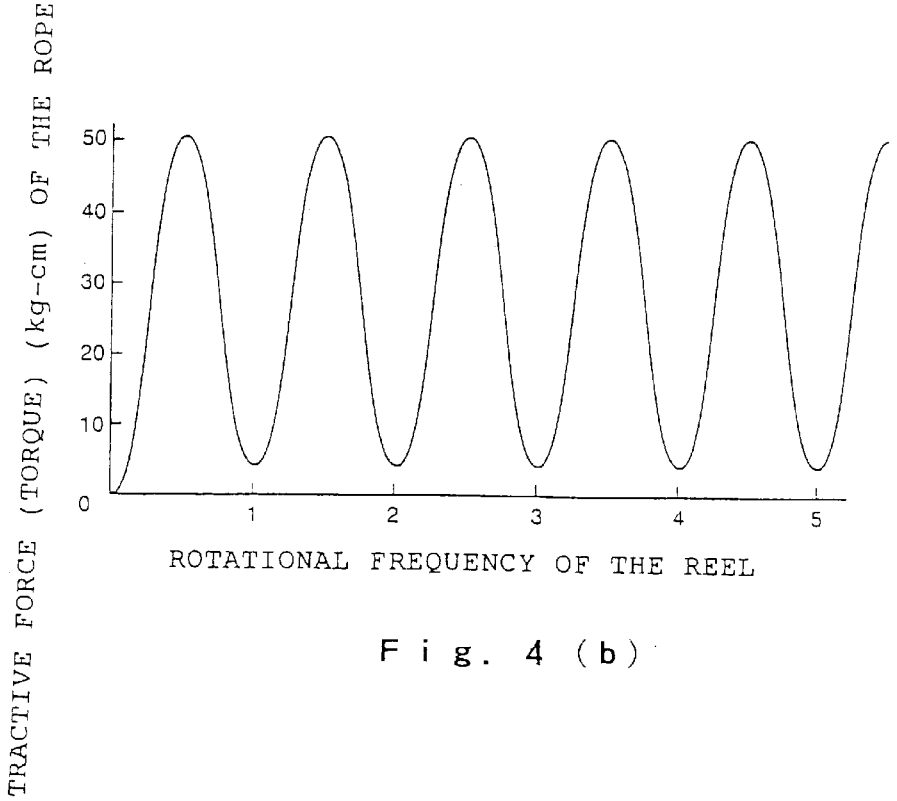
Figure 5:
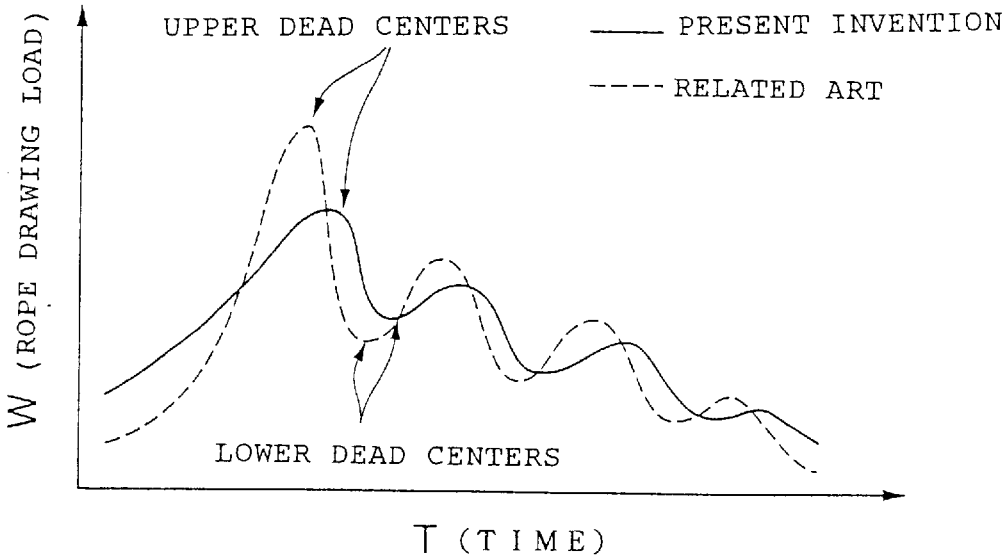
FIG. 5 is a drawing showing the relation between a rope drawing load and time in the recoil starter according to the present invention and a related art recoil starter.

FIG. 1 is a sectioned side view showing an embodiment of the recoil starter according to the present invention, FIG. 2 a sectional view taken in the direction of arrows a—a in FIG. 1, FIG. 3 a longitudinal sectional view taken along the line b—b in FIG. 1, FIG. 4 a drawing showing the relation between a tractive force (starting torque of the engine) of a rope and a rotational frequency of a reel in the recoil starters, in which FIG. 4A shows the mentioned relation in the recoil starter according to the present invention, and FIG. 4B the mentioned relation in a related art recoil starter, and FIG. 5 a drawing showing the relation between a rope drawing load and time in the recoil starter according to the present invention and a related art recoil starter. Reference numerals 1-1, 1-2 denote starter cases, 2 a starter shaft, 3-1, 3-2 bearing portions, 4 a reel, 5 a cam plate, 6 a tightening nut, 7 ratchets, 8 a rope, 9-1, 9-2 spiral springs, 10 a slit, 11 a retaining ring, 12 a dust seal, and 13 a return springs.

Referring to FIGS. 1–3, the starter cases 1-1, 1-2 are engaged with each other in one body so as to have a stepped outer surface, and supported on the starter shaft 2, which is passed through a central portion of the starter cases, via the bearing portions 3-1, 3-2. The cam plate 5 is mounted fixedly by the tightening nut 6 on the portion of the starter shaft 2 which is on the side of a crankshaft (not shown), the cam plate being thereby rotated with the starter shaft 2. A reel 4 around an outer circumference of which the rope 8 is wound is mounted on the portion of the starter shaft 2 which is between the bearing portions 3-1, 3-2 so that the reel can be turned freely. The spiral spring 9-1 urged in the direction in which the rope 8 both end portions of which are fixed to the starter case 1-1 and reel 4 is taken up is housed in the portion of the reel 4 which is on the side of the crankshaft (not shown). The spiral spring 9-2 adapted to transmit a rotational force of the reel 4, which occurs when the rope 8 both end portions of which are fixed to the reel 4 and starter shaft 2 is drawn out, to the starter shaft 2 with an elastic action is housed in the portion of the reel 4 which is on the opposite side of the crankshaft. The spiral spring 9-1 is engaged at an inner end portion thereof with the starter case 1-1, and at an outer end portion thereof with the reel 4, while the other spiral spring 9-2 is engaged at an inner end portion thereof with the slit 10 provided in the starter shaft 2, and at an outer end portion thereof with the reel 4. A flywheel (not shown) mounted on the crankshaft (not shown) is provided on a side surface thereof with ratchets 7 which are meshed with cam portions 5*a* of the cam plate 5 when the engine is started, and which are urged inward by the return springs 13. The bearing portion 3-1 is provided therein with a dust seal 12 so that the entry of mud and dust from the side of the case 1-1 into the interior of the recoil starter does not occur.

The operation of the present invention constructed as mentioned above will now be described. When the rope 8 is drawn with the ratchets 7 meshed as shown in FIG. 2 with the cam portions 5*a* of the cam plate 5 in a not-yet-started, i.e. stopped condition, the reel 4 is turned, and the spiral springs 9-1, 9-2 also starts being turned. However, due to the presence of a rotational load of the engine, the shaft 2 remains in a non-rotatable condition until a certain degree of power is accumulated in the spiral spring 9-2. When the level of the accumulated power of the spiral spring 9-2 exceeds in short that of the rotational load of the engine, the shaft 2 is turned to cause the flywheel and crankshaft to be rotated via the ratchets 7 meshed with the cam plate 5, so that the engine is started. During this time, the rotational force of the rope 8 continuously drawn out is added to the rotational force occurring due to the released accumulated power of the spiral spring 9-2, so that the speed of rotation which causes the engine to be rotated can be increased.

Thus, according to the present invention, a peak load at the engine starting time is absorbed in the spiral spring 9-2 which transmits the rotational force of the reel 4 to the starter shaft 2 with an elastic action, and the shocks transmitted to the hand and arm is therefore lessened. When the rope 8 is released after the engine is started, the ratchets 7 are turned outward by a centrifugal force to cause the cam plate 5 to be released. Consequently, the reel 4 is rotated reversely by the spiral spring 9-1, and the rope 8 is rewound around the reel 4. When the engine is stopped, the ratchets 7 are slidingly moved on the cam plate 5 and returned to the original positions.

The peak load reducing effect of the recoil starter displayed at the engine starting time will now be described on the basis of FIGS. 4 and 5.

First, in the case of a related art recoil starter, a force which the hand drawing the rope 8 feels is as shown in FIG. 4B assuming that the engine starting torque is 50 kg-cm, i.e., the hand feels rugged motions like knocking motions. Namely, the hand receives large shocks. In the case of the recoil starter according to the present invention, such a force as mentioned above is as shown in FIG. 4A assuming that the torque of the accumulated power of the spiral spring 9-2 is 20 kg-cm, and that the spiral spring 9-2 is wound and contracts to the last at two turns of the reel 4. Consequently, not only the force for drawing the rope 8 becomes about 30 kg-cm which is smaller than that in a related art recoil starter but also a difference between a maximum tractive force of the rope and a minimum tractive force thereof becomes small, so that rugged motions which the hand feels decrease.

Although setting the torque of the accumulated power of the spiral spring 9-2 in the recoil starter according to the present invention to ½ of the starting torque is more effective, it is preferable that the torque be set with the durability and economical efficiency of the spiral spring 9-2 and other parts taken into consideration.

A difference between the rope drawing load of a related art recoil starter and that of the recoil starter according to the present invention will now be described on the basis of FIG. 5.

In a related art recoil starter, the rope drawing load W becomes maximum at a first compression stroke passing a first upper dead center, and the upper dead center load thereafter lowers due to an inertial effect, and ignition occurs in the midst of this load lowering time. In the recoil starter according to the present invention, a part of the load is absorbed in a position in the vicinity of an upper dead center owing to the effect of the spiral spring 9-2, and discharged in a position in the vicinity of a lower dead center. These operations are repeated in order at every compression stroke. Thus, a maximum load which the hand drawing the rope feels decreases generally, and a rugged motion which is ascribed to the variation of the load, and which the hand feels is lessened.

According to the present invention described above, the reel and starter shaft are formed separately with a spiral spring which has an elastic action interposed therebetween so as to absorb a peak load at the engine starting time in this spiral spring. Owing to this construction, a peak load at the time of an engine starting operation of the recoil starter can be reduced, and shocks given to the hand and arm can be lessened. Furthermore, owing to the dust seal incorporated in a bearing portion, the recoil starter is resistant to dust including sand and litter.

What is claimed is:

1. A recoil starter comprising a starter case having a first bearing extending around an axis of a crankshaft; a rotatable starter shaft having opposite first and second ends, the first end being passed through the first bearing for connection to the crankshaft; a one-way clutch mechanism formed between the first end of the starter shaft and an engine; a second starter case united with the first starter case and having a second bearing supporting the second end of the starter shaft; a reel mounted on a portion of the starter shaft between the first and second bearings so that the reel can be turned with respect to the starter shaft; a rope wound in a groove of the reel; a first spiral spring having ends fixed respectively to the second starter case and the reel and urged in a direction in which the rope is taken up; and a second spiral spring having ends fixed respectively to the reel and the starter shaft and adapted to transmit a rotational force of the reel with an elastic action to the starter shaft when the rope is drawn out.

2. A recoil starter according to claim 1, wherein a dust seal is provided in the first bearing extending around the axis of the crankshaft.

3. A recoil starter comprising:

a rotatable starter shaft having an axis and being adapted to be turned around the axis, the starter shaft having opposite first and second ends, a starter case mounted to the starter shaft by first and second bearings in proximity to the respective first and second ends of the starter shaft such that the starter case and the bearings rotationally support the starter shaft at the opposite ends thereof, a reel rotatably mounted on the starter shaft and disposed within the starter case, the reel having a groove, and a rope being wound in the groove of the reel, a first spiral spring disposed within the starter case, the first spiral spring having one end engaged with the starter case and an opposed end engaged with the reel, the first spiral spring being disposed for exerting forces in a direction in which the rope is taken up on the reel, and a second spiral spring disposed in the starter case, the second spiral spring having one end fixed to the reel and an opposed end fixed to the starter shaft, the second spiral spring being adapted to transmit with an elastic action a rotational force of the reel to the starter shaft when the rope is drawn out from the reel.

4. A recoil starter according to claim 3, wherein a dust seal is provided in the first bearing extending around the axis of the crankshaft.

* * * * *